US005785245A

United States Patent [19]

Tedders, Jr. et al.

[11] Patent Number: 5,785,245

[45] Date of Patent: Jul. 28, 1998

[54] BACKPACK SPRAYER FOR ARTHROPOD, ARTHROPOD EGGS, OR ARTHROPOD EGG PARASITOIDS CONTAINED IN ARTHROPOD EGGS

[75] Inventors: Walker Louis Tedders, Jr.; John L. Blythe, both of Perry, Ga.

[73] Assignee: The United States of America as represented by the Secretary of Agriculture, Washington, D.C.

[21] Appl. No.: 518,866

[22] Filed: Aug. 24, 1995

[51] Int. Cl.[6] ..... A62C 5/02

[52] U.S. Cl. ..... 239/9; 239/142; 239/152; 239/373

[58] Field of Search ..... 239/152–154, 239/351, 340, 337, 373, 142–144, 8, 9, 364–366, 368, 369, 372

[56] References Cited

U.S. PATENT DOCUMENTS

| | | | |
|---|---|---|---|
| 585,503 | 6/1897 | Black | 239/152 |
| 587,890 | 10/1897 | Weaver | 239/366 X |
| 2,519,707 | 8/1950 | Schaffer | 239/142 X |
| 2,860,918 | 1/1958 | White et al. | 239/351 X |
| 2,958,155 | 11/1960 | Emmerich | 239/153 X |
| 3,801,015 | 4/1974 | Hayes | 239/143 X |
| 4,308,996 | 1/1982 | Rotolico | 239/290 |
| 4,635,830 | 1/1987 | Wehr et al. . | |
| 4,781,329 | 11/1988 | Tenney et al. | 239/365 X |
| 4,798,333 | 1/1989 | Luchsinger . | |
| 4,801,088 | 1/1989 | Baker | 239/152 |
| 4,966,329 | 10/1990 | Show | 239/650 |
| 5,061,697 | 10/1991 | Shasha et al. | 514/60 |

FOREIGN PATENT DOCUMENTS

| | | | |
|---|---|---|---|
| 530001 | 12/1940 | United Kingdom | 239/143 |
| 860947 | 9/1957 | United Kingdom | 239/143 |

OTHER PUBLICATIONS van de Vrie and Price, "Manual for Biological Control of Twospotted Spider Mites on Strawberry in Florida", *Dover Research Report* DOV 1994–1, p. 1–10, Jul. 1994.

*Primary Examiner*—Kevin Weldon

*Attorney, Agent, or Firm*—M. Howard Silverstein; John Fado; Gail E. Poulos

[57] ABSTRACT

A backpack sprayer for spraying arthropods or arthropod eggs, such as beneficial mites or beneficial insect eggs, or insect eggs containing parasitoids, directly onto plants is disclosed which uses excess air generated by a compressor to produce a coarse or fine spray of an aqueous suspension containing the arthropods or eggs as they exit from a spray gun. A stir bar magnet in a spray tank, controlled by a magnetic stirrer motor, keeps the arthropods or eggs evenly suspended in an aqueous solution. The sprayer provides an economical and alternative strategy for the delivery of arthropods such as beneficial mites and eggs to agricultural commodities.

5 Claims, 6 Drawing Sheets

BACKPACK SPRAYER FOR ARTHROPOD, ARTHROPOD EGGS, OR ARTHROPOD EGG PARASITOIDS CONTAINED IN ARTHROPOD EGGS

BACKGROUND OF THE INVENTION

1. Field of the Invention

This invention relates to a backpack sprayer for applying arthropods, insect eggs, or insect parasitoids contained in insect eggs, onto agricultural commodities. It is especially useful for the application of beneficial arthropods such as mites, insect eggs, such as lacewing eggs, or insect parasitoids such as *Trichogramma pretiosum* contained in insect eggs.

2. Background of the Prior Art

Chemical insecticides are used to control insects that damage agricultural commodities. However, recent concerns about insecticide residues on commodities, resistance of insects to chemical insecticides, hazardous exposure to pesticide applicators, environmental contamination, destruction of natural biocontrol agents such as beneficial insects, and lack of newly developed insecticides have increased the need for alternative control methods. Furthermore, as pests become more resistant to pesticides, more frequent treatments are required which increases the human health hazard.

An alternative to chemical pesticides is the use of biocontrol agents such as beneficial or predacious arthropods which eat harmful arthropods. However, there is no known way to deliver known quantities of these insects to pest infested plants. A major problem associated with continued development of the biocontrol industry is the lack of equipment for applying evenly distributed living organisms to target plants without injury to the beneficial species. The development of such equipment is paramount to development of the biocontrol industry. Beneficial arthropods or insect eggs are usually applied to plants by shaking them from a container onto the foliage. A large percent fall to the ground and are quickly destroyed by ants and other predators. Larvae that emerge from the fallen eggs which escape predators usually are unable to find their way back up the plant and starve to death allowing the infesting insect to continue to do damage. The application of insects is very labor intensive. For example, to apply predaceous mites to strawberries, a worker shakes a small amount of a vermiculite predator mixture into the center of every 4th or 5th plant in order to achieve a release rate of one predator per plant (Manual of Biological Control of Twospotted Spider Mites on Strawberry in Florida, Dover Research Report: DOV 1994-1, 1-9, July, 1994). With this method it is very difficult to maintain a homogeneous mixture of mites and vermiculite because mobile mites migrate into the upper strata of the vermiculite.

U.S. Pat. No. 4,966,329 (Show) discloses an applicator for distributing beneficial insects which are mixed with a solid particulate carrier to plants positioned below the applicator. The applicator could not be used for dispersing arthropods such as mites in an aqueous suspension or insect eggs mixed in an aqueous suspension containing a sticking agent or to disperse insects onto high growing plants.

Various backpack sprayer have been developed for applying liquid compositions such as herbicides and insecticides. These devices are unsatisfactory for applying beneficial arthropods such as mites or insects because of damage they cause to the organisms. There remains a need in the art for a more effective way of economically applying large quantities of beneficial arthropods, with equal distribution, to pest infested plants. The development of such equipment is paramount to the development of the use of biocontrol agents in agriculture.

The present invention provides a simple cost effective alternative strategy for delivering arthropods in any life stage, especially beneficial arthropods such as mites and insect eggs which is different from prior art devices and solves some of the problems associated with the prior art.

SUMMARY OF THE INVENTION

It is therefore, an object of the present invention to provide a sprayer for applying aqueous suspensions of arthropods, insect eggs, or insect parasitoids contained in insect eggs unharmed onto plants.

Another object of the present invention is to provide a sprayer for applying beneficial arthropods, insect eggs, or insect eggs containing insect egg parasitoids unharmed onto plants.

Another object of the present invention is to provide a sprayer which dispenses a constant number of arthropods or arthropod eggs regardless of the amount of arthropod or egg suspension in the spray tank.

A still further object of the present invention is to provide a sprayer for dispensing arthropods or arthropod eggs at a constant rate by adjustment of a back-pressure regulator.

A further object of the present invention is to provide a sprayer which uses excess air generated by a compressor capable of creating a spray and propelling arthropods or arthropod eggs onto plants.

Further objects and advantages of the present invention will become apparent from the following description.

DETAILED DESCRIPTION OF THE INVENTION

Figure 1:
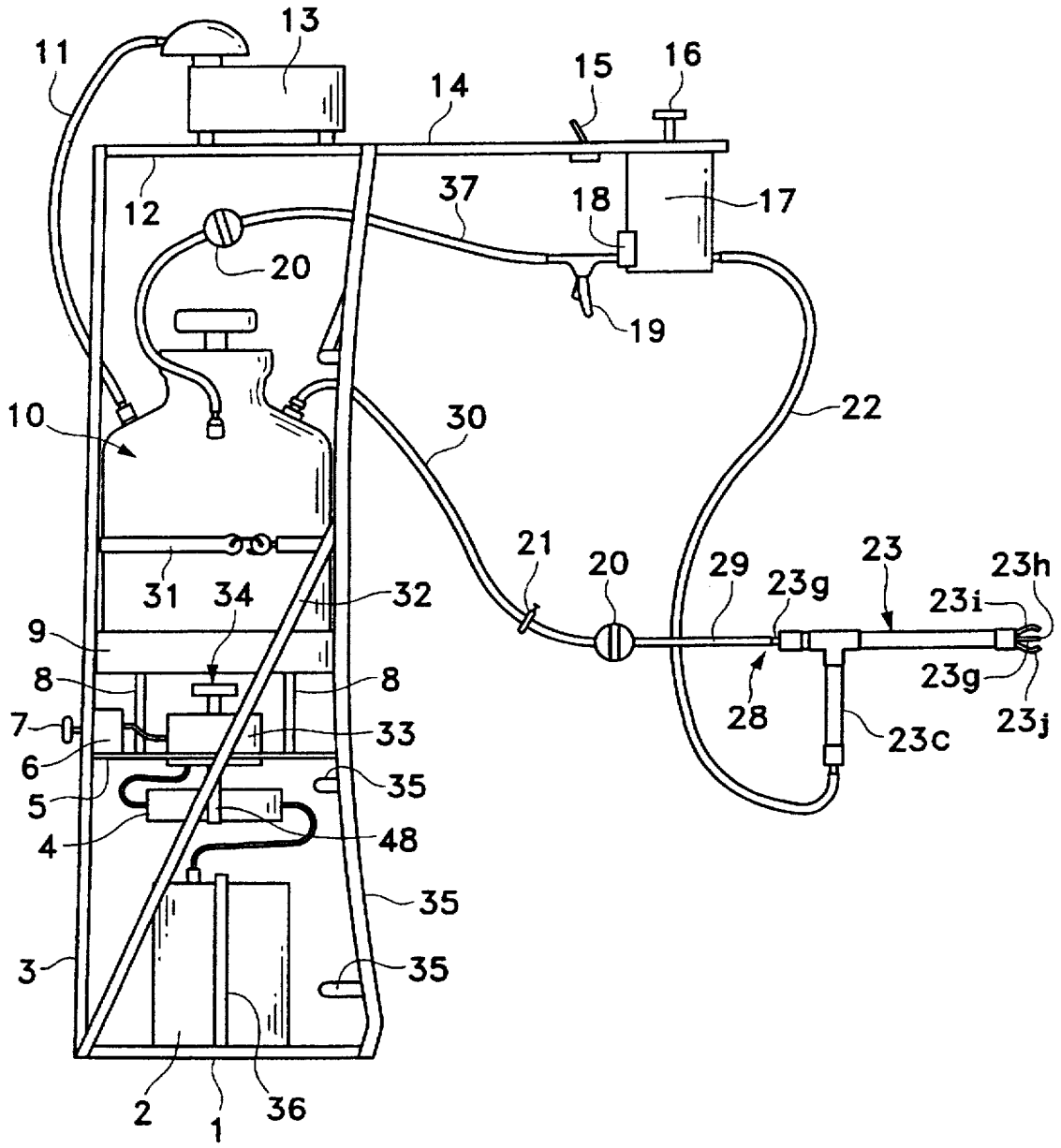
FIG. 1 is a side view of backpack sprayer 40 showing backpack frame 35, battery 2, spray tank 10, compressor 13, back-pressure regulator 17, and spray gun 23.

Backpack sprayer 40, incorporating the features of the present invention, is illustrated in FIGS. 1–6. Sprayer 40 is useful for spraying aqueous suspensions of arthropods such as mites, arthropod eggs such as lacewing eggs, or arthropod egg parasitoids contained in arthropod eggs such a *Trichogramma pretiosum* contained in *Ephestia kuhniella* eggs. It is especially useful for spraying aqueous suspensions of beneficial arthropods such as mites, eggs of beneficial insects, and insect eggs containing insect parasitoids onto plants. The following description will be directed to spraying beneficial arthropods, or insect eggs. Components of sprayer 40 include a 12-V deep cycle (DC) battery 2, magnetic stir-bar stirring device 34, 1-gallon pressurized spray tank 10, 12-VDC diaphragm compressor 13, a back-pressure regulator 17, a spray gun 23, a backpack frame 35, and various tubes and hoses. Sprayer 40 utilizes several different adhesives for sticking insect eggs onto the plant foliage and a water/surfactant mixture for applying living arthropods such as mites. The sprayer is unique because it can dispense insect eggs and arthropods unharmed to plant foliage. Furthermore, the sprayer can deliver a constant rate of eggs or arthropods regardless of whether the spray tank is fully loaded or nearly empty.

Figure 2:
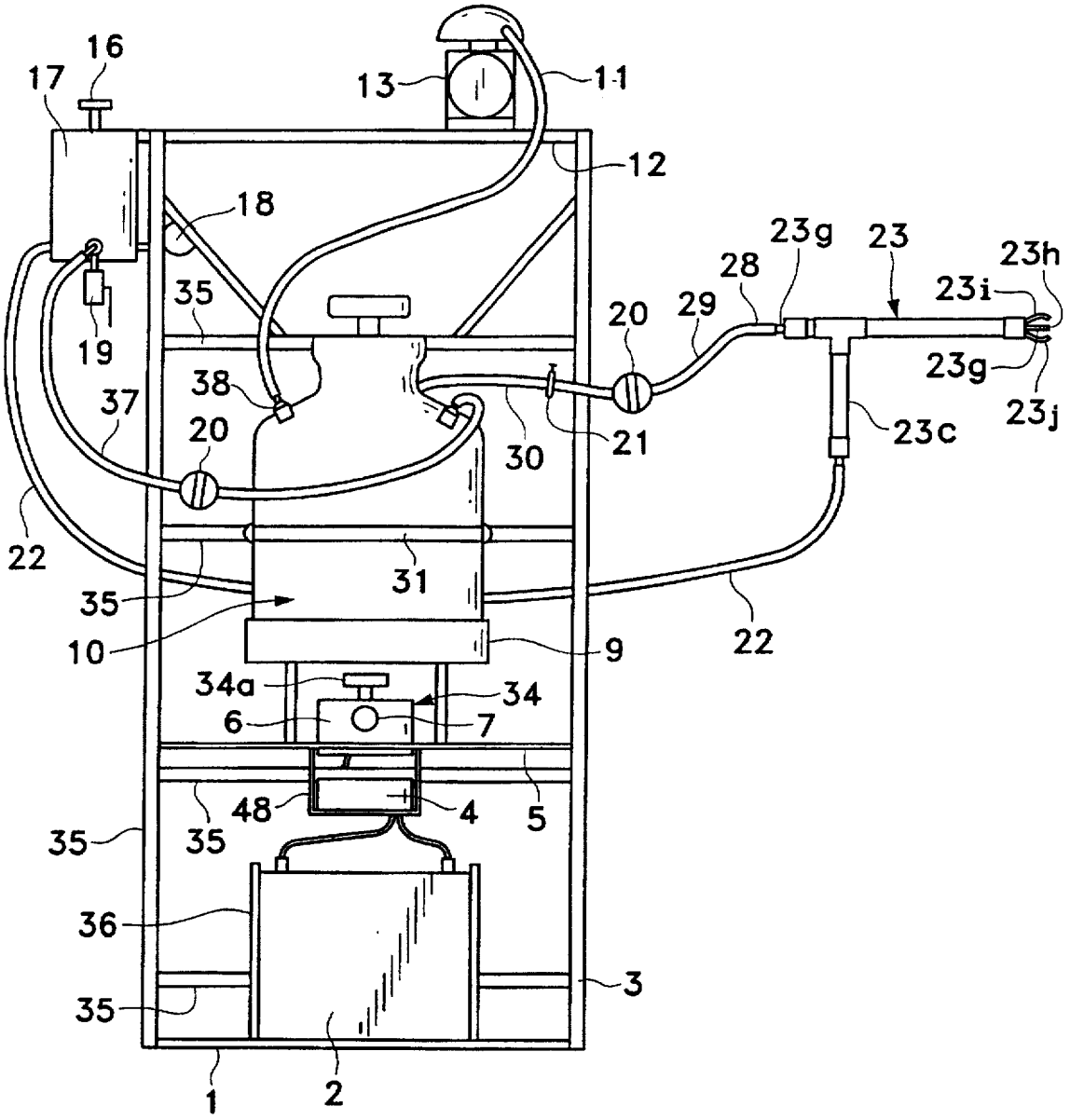
FIG. 2 is a rear view of backpack sprayer 40.
Figure 3:
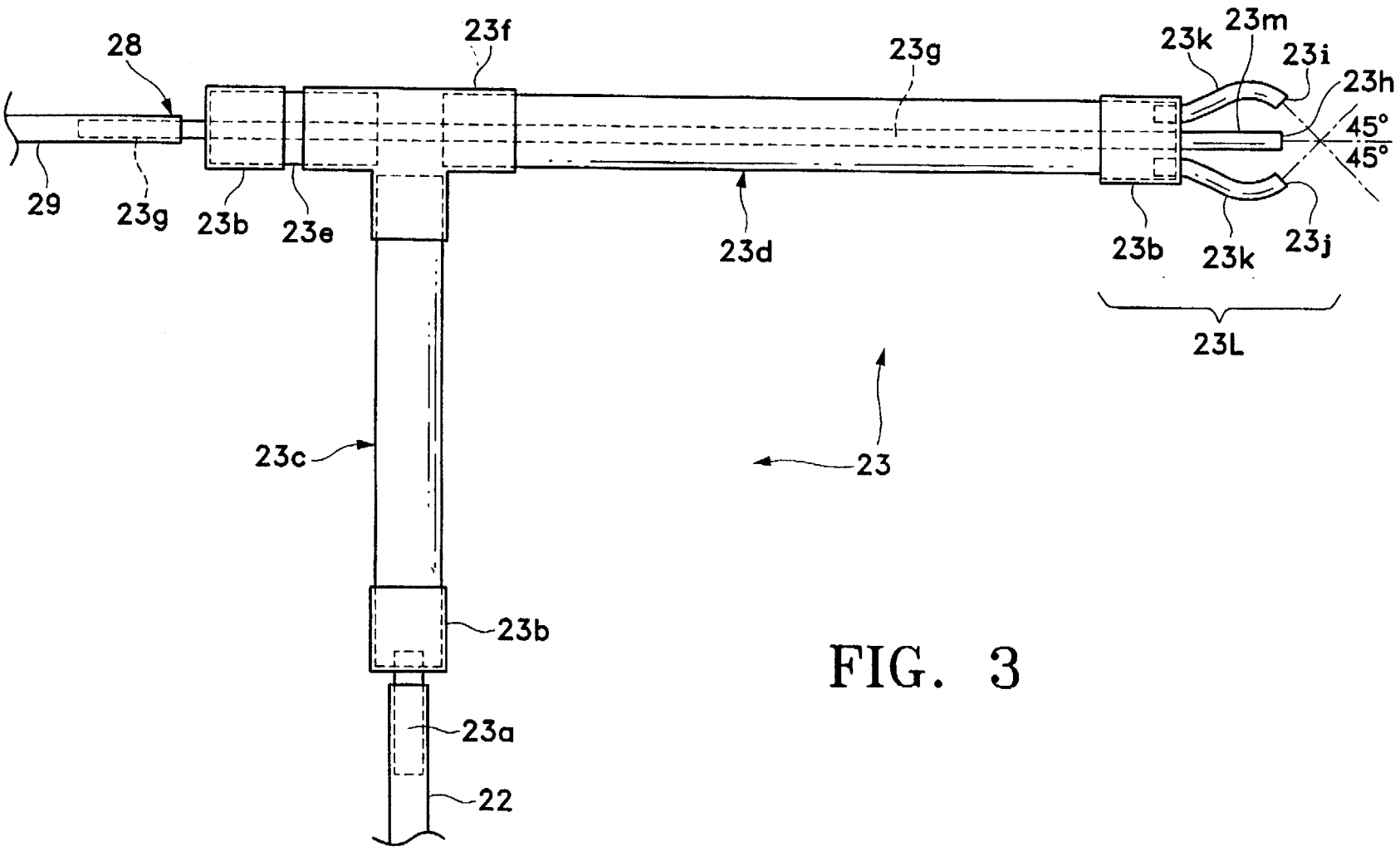
FIG. 3 is a side view of spray gun 23 showing aqueous suspension line 29, air bleed-off line 22, upper air outlet **23*i*, lower air outlet 23*j*, aqueous suspension outlet port 23*h*, gun handle 23*c*, and gun body 23*d***.

Sprayer 40 has an air system that uses excess air generated by compressor 13, which is normally discharged by back-pressure regulator 17, to disperse insects or eggs as they exit spray gun 23. The air system has spray gun 23 (FIGS. 1–3) connected to back-pressure regulator 17 by air bleed-off line 22 which is 3/16" ID TYGON™ tubing (FIG. 1–3). Tubing 22 fits over a 1" length of ¼" OD copper tube **23*a* which attaches to gun 23 through a ½" copper cap 23*b* which fits over the base of handle 23*c* of gun 23 (FIG. 3). Handle 23*c* is made up of a 4" length of ½" ID rigid copper tube which attaches to body 23*d* of gun 23 using a ½" copper T 23*f*. Body 23*d* is a 6" length of ½" ID rigid copper tube which is connected through ½" copper T 23*f* to a 1¼" piece of ½" ID rigid copper tube 23*e*. Attached to the inlet end of tube 23*e* is a ½" copper cap 23*b*. At the outlet end of body 23*d* is nozzle 23*L* which has a copper cap 23*b* through which extends two 1" lengths of ⅛" OD copper tube 23*k* inserted into cap 23*b* on either side of aqueous suspension outlet 23*m* which forms port 23*h* at the outlet end. The outlet ends of tubes 23*k* form upper air outlet 23*i* and lower air outlet 23*j*. Tubes 23*k* are inserted into cap 23*b* so that the air exiting from outlets 23*i* and 23*j* intersects the aqueous suspension flow from aqueous suspension outlet port 23*h* at 45° angles. All unions of copper caps with copper tubes and copper tubes inserted through copper caps are sealed by soldering. Back-pressure regulator 17, including a 0–30 psi pressure gauge 18 and control knob 16, also connects to spray tank 10 through bleed-off line 37 which is 3/16" ID TYGON TM tubing which connects to regulator 17 at pressure release valve 19 (FIGS. 1 and 2). Regulator 17 is attached with two ¼"×1" machine bolts to the outer end of the underside of controls support arm 14. Line 37 has a ¼" quick disconnect 20 between the regulator 17 and spray tank 10**.

Figure 4:
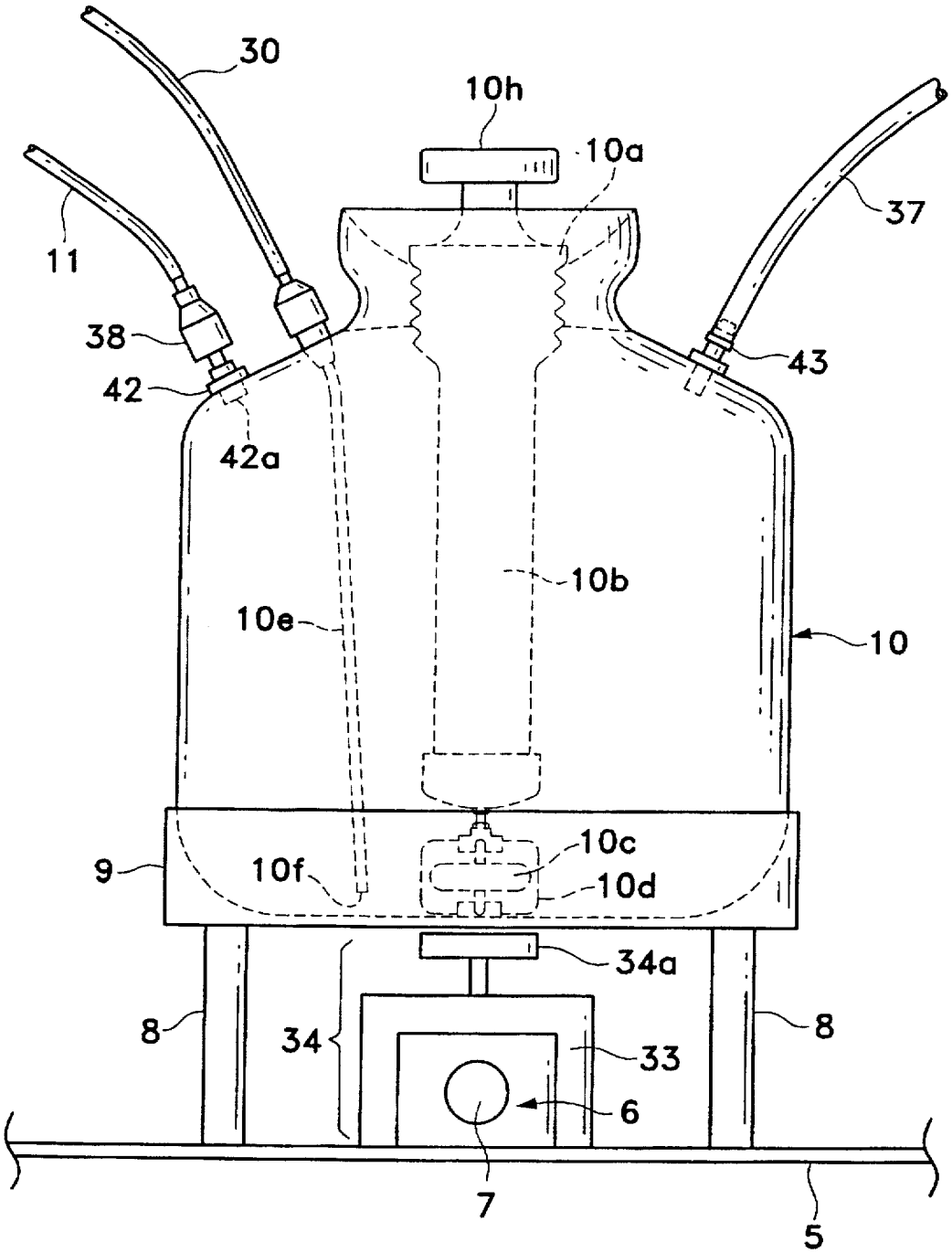
FIG. 4 is a side view of spray tank 10 showing pump housing **10*b*, stir bar magnet 10*c*, and aqueous suspension pick up tube 10*e* and rheostat 6**.
Figure 5:
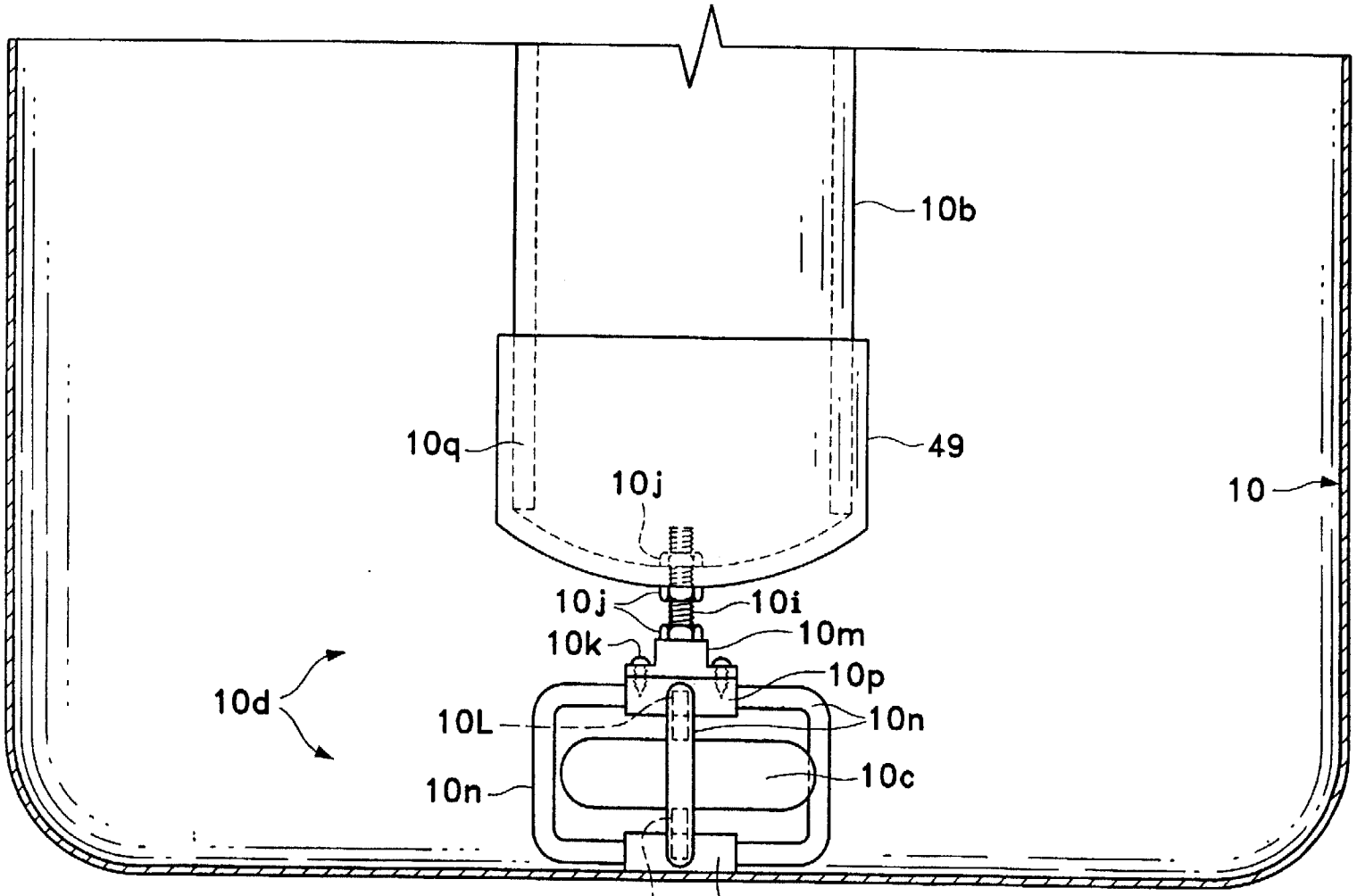
FIG. 5 is a side view of magnetic stir bar assembly **10*d* showing brass threaded rod 10*i*, spindle attachment 10L holding stir bar magnet 10*c*, nylon flange 10*m*, supporting frame assembly 10*n*, and nylon receptacle 10*p* for frame and spindle attachment, and spindle attachment 10L holding stir bar magent 10*c***.

An aqueous system provides for the flow of the suspension of arthropods such as mites or eggs from spray tank 10 to outlet port **23*h* of spray gun 23 where the suspension is propelled onto the plants by pressure on the aqueous solution and air exiting the air system through upper and lower air outlets 23*i* and 23*j* and the aqueous suspension outlet port 23*h* (FIG. 3), respectively. Compressor 13, a 12 VDC Gast diaphragm compressor (Thomas Industries, Inc., Power Air Division, 1419 Illinois Ave., Sheboygan, Wis. 53082), sits on top shelf 12 of frame 35 on the opposite side from regulator 17 and it attaches to spray tank 10 through compressed air line 11 which is 3/16" ID TYGON™ tubing (FIGS. 1 and 2). Compressor 13 provides air pressure to move the suspension out of tank 10 to outlet 23*h*. Spray tank 10 is a 1 gallon spray tank with four ports: pressurization port 42*a*, aqueous suspension pick-up tube port 10*f*, pressure bleed off port 43*a* for producing a fine spray as suspension exits spray gun 23 and tank fill port 10*a* (FIG. 4). Spray tank 10 is, for example, a commercially available 1 gallon spray tank such as RL Flo-Master Funnel Top Sprayer,(RL Corp., Lowell, Mich., 49331) sits on tank mount shelf 9 and is secured by rubber tie-down 31 (FIGS. 1 and 2). Any commercially available spray tank can be adapted for use with sprayer 40. To utilize the entire volume of arthropod, such as mites, or egg suspension, the inside bottom of spray tank 10 should be concave. Tank 10 needs to be placed precisely over motor 33 so that magnet 34*a* is located below the center of the tank. If it is not centered, magnet 34*a* will not turn stir bar magnet 10*c*. Shelf 9 is supported by tank mount supports 8 which are attached to middle shelf 5 of frame 35. Tank 10 is modified by removing the original pump assembly (not shown) from pump housing 10*b*. Housing 10*b*, which serves as the closing and seal of tank fill port 10*a*, is modified in the following manner: The original hand pump assembly (not shown) is removed from pump housing 10*b*. Housing 10*b*, which serves as the closing and seal of tank fill port 10*a*, is modified by removing the rubber check valve and sealing the opening with an appropriate size PVC cap 49. For the RL Flo-Master Funnel Top Sprayer, a 1½" PVC cap is turned on a lathe to remove approximately about 1/16" of the inside wall to the base of the cap in order to fit it to base 10*q* of pump housing 10*b* (FIG. 5). PVC glue is used to attach cap 49 to the base 10*q* of pump housing 10*b*. Magnetic stir bar assembly 10*d* is attached to the lower side of PVC cap 49. Assembly 10*d* is made up of stir bar magnet 10*c* mounted in supporting frame assembly 10*n* with spindle attachment 10L. Attachment 10L and frame ion are inserted into to nylon receptacles 10*p*. Attached to upper receptacle 10*p* plate, with small brass screws 10*k*, is nylon flange 10*m*. A ¾" long ⅛" brass threaded rod 10*i* extends from flange 10*m* into PVC cap 49, attaching the magnetic stir bar assembly 10*d* to pump housing 10*b* with ⅛" brass nuts 10*j*. Pump housing 10*b*, with stir bar assembly 10*d*, is inserted into fill port 10*a* and tightened by turning pump handle 10*h* clockwise to seal the system (FIG. 4 and 5). Magnetic stir bar assembly 10*d* should be as close to the bottom of tank 10 so that arthropods and eggs remain evenly distributed when there is a very small volume of suspension remaining. A 3/16" plastic pick-up tube 10*e* and plastic adapter 10*g* are original parts of the hand sprayer and formerly served as the connection point of the original hose and wand (FIG. 4). Aqueous suspension pick-up tube port 10*f* is formed by the inlet end of tube 10*e* which attaches to the inlet end of adapter 10*g*. Attached to the outlet end of adaptor 10*g* is aqueous suspension line 30 which is 3/16" ID TYGON™ tubing. Line 30 attaches to a quick disconnect 20. Line 30 can be regulated by a TYGON™ tube flow regulator 21 located upstream from quick disconnect 20 (FIGS. 1 and 2). Quick disconnect 20 attaches line 30 to spray gun 23 through aqueous suspension line 29 which is ⅛" ID TYGON™ tubing. Line 29 has pressure point 28 at the outlet end that can be pressed closed when needed to shut off the dispensing of aqueous solution. Line 29 connects to spray gun 23 on the inlet end of a 10" length of ⅛" OD copper tubing 23*g*. The outlet end of tubing 23*g* exits spray gun 23 through cap 23*b* to form aqueous suspension outlet 23*m* with outlet port 23*h*. Spray tank 10 is further modified by drilling a ⅜" hole in the top shoulder of tank 10 (FIG. 4). A ¼" bulkhead fitting 42 is mounted in the hole and a ¼" air line quick disconnect 38 is attached to the inlet end of fitting 42. Quick disconnect 38 puts tank 10 in communication with compressor 13 through line 11. Spray tank 10) is also modified by drilling a ⅜" hole in the shoulder opposite fitting 42. A ¼" bulkhead fitting 43 is mounted in this hole and bleed-off line 37 is attached to the outlet end of fitting 43 placing tank 10 in communication with spray gun 23**.

Figure 6:
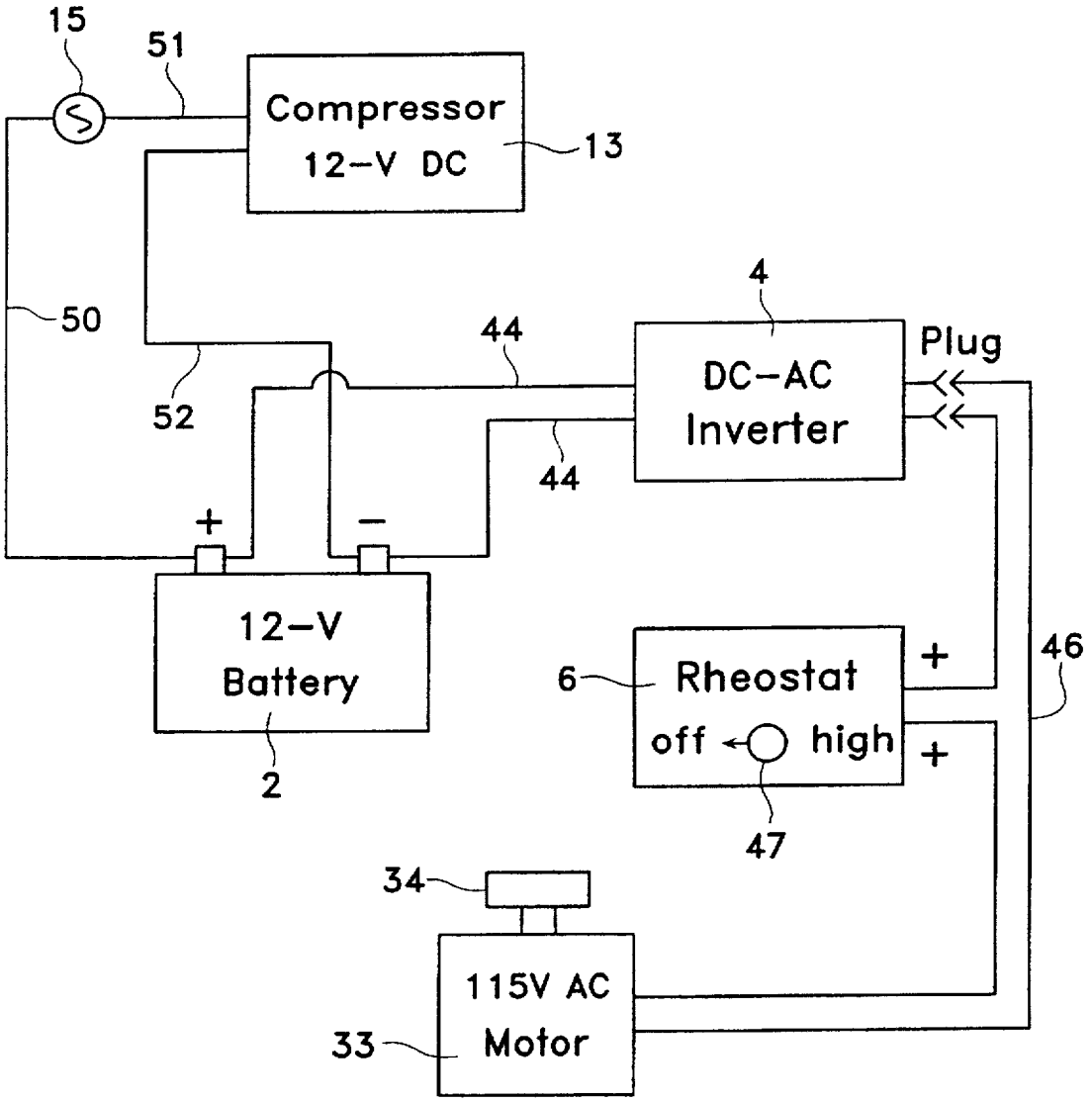
FIG. 6 is a schematic wiring diagram for sprayer 40.

Power is supplied by 12 VDC (deep cycle) battery 2 which sits on bottom shelf 1 of backpack aluminum frame 35 (Camp Trails, P.O. Box 966, Binghamton, N.Y., 13902) (FIGS. 1 and 2). Battery 2 is secured to the shelf by battery tie-down 36. A DC-AC inverter 4 (Power Inverters, Clear-line Concepts, Corp., 85 Fulton St., Boonton, N.J., 07005) is secured to the underside of frame middle shelf 5 with bracket 48. Wire 44, leading from inverter 4 splits and connects to both the positive and negative terminal of battery 4. Inverter 4 is connected through wire 46 to 115-V magnetic stir motor 33 that has a rotating bar magnet 34*a*. Motor 33 with rotating bar magnet 34*a* is obtained from a magnetic stirrer and is attached to middle shelf 5 of frame 35. Motor 33 is connected to an on/off rheostat 6 with wire 47 (FIG. 6). A heavy duty toggle switch 15 located on controls support arm 14 between compressor 13 and regulator 17, serves as an on/off switch for compressor 13. Switch 15 receives the positive (+) lead wire 50 (FIG. 6) from battery 2. The outlet terminal of switch 15 is connected wire 51 (FIG. 6) to the positive (+) lead wire of compressor 13. Negative (−) lead wire 52 connects the negative (−) terminal of battery 2 to the negative (−) lead wire of compressor 13 (FIG. 6) Rheostat 6 sits on the back of middle shelf 5 out side of tank mount support 8. Control knob 7 of Rheostat 6 allows adjustment of the speed of magnet 34*a*. Magnet 34*a* turns stir bar magnet 10*c* inside tank 10.

Aqueous suspensions for use in backpack sprayer 40 may include lacewing eggs (Chrysoperla), *Trichogramma* spp. in Sitotroga or Ephestia eggs, or mites (*Phytoseiulus* spp., Neoseiulus spp. or Metaseiulus spp.). Adhesives added to water for attaching lacewing eggs, Ephestia eggs or Sitotroga eggs to plant foliage include Smucker Biocarrier (Smucker Manufacturing, Inc., 22919 Coburg Road, Harrisburg, Oreg. 97446) (U.S. Pat. application Ser. No. 08/423,765, herein incorporated by reference), or combinations of sucrose-flour or sucrose-starch mixtures (U.S. Pat. No. 5,061,697, which is herein incorporated by reference). Surfactants for mites are common liquid dishwashing detergents. The detergent DAWN® (40 mg/L water) has been used with little or no apparent effects on mites. Surfactant is necessary to break surface tension of the water so that mites do not float but go into suspension. Spray containing mites quickly dries on plants and the mites then begin searching activity for prey.

The concentration of sticking agents, for eggs in water, ranges from about 2% to about 11% for good to excellent adhesive properties to achieve a high percentage of eggs hatching. The sticking agent can be any sprayable adhesive agent which is not toxic to the insect eggs and does not foul the sprayer. Examples of useful sticking agents are a starch-sucrose formulation, or a flour-sucrose formulation, both as disclosed in U.S. Pat. No. 5,061,697, which is herein incorporated by reference in its entirety; and Smucker Biocarrier (Smucker Manufacturing, Inc. 22919 No. Coburg Road, Harrisburg, Oreg. 97446). The beneficial insect eggs are used at a concentration of at least about 1,000 eggs per gallon. A limitation of the upper concentration range is the amount of eggs which will the clog aqueous suspension assembly.

Aluminum frame 3 supports sprayer 40. Frame 3 is made up of aluminum frame upright 3; three shelves to support the components of sprayer 40: bottom shelf 1, middle shelf 5, and top shelf 12; tank mount shelf 9, and frame brace 32 (FIGS. 1 and 2) . Extending outward from shelf 12, is controls support arm 14 which supports heavy-duty toggle switch 15 and back pressure regulator 17. Any commercially available backpack frame can be modified to support sprayer 40.

In operation, a maximum of ¾ gallon of the aqueous suspension containing insect eggs or arthropods, such as mites, is loaded into spray tank 10 through port 10*a*. Pressurized air from compressor 13 is pumped into tank 10 to pressurize the tank and move the suspension from tank 10 out through pick-up tube 10*e*, through line 30, to spray gun 23 and outlet port 23*h*. The insects or eggs are kept evenly suspended in the aqueous suspension by stir bar magnet 10*c*. Magnet 10*c* is controlled by magnetic stir motor 33 through rheostat 6 control knob 7. Back pressure regulator 17 allows for dispensing insects or eggs at a constant rate as predetermined by adjustment with control knob 16 of regulator 17. Excess air generated by compressor 13 and normally discharged by back-pressure regulator 17 leaves tank 10 through bleed-off line 37 and is piped through back pressure regulator 17 with pressure gauge 18, enters bleed-off tube 22 and enters spray gun 23 through copper tube 23*a*. The air exits from two directions at 45° angles through tubes 23*i* and 23*j* and acts from two directions on the aqueous suspension which exits from outlet 23*h* which is located between outlets 23*i* and 23*j*. The force of the excess air on the suspension produces a fine spray pattern capable of covering plants up to eight feet away. The force of the excess air is determined by the speed of compressor 13 and the operating psi of regulator 17. The rate of flow of aqueous suspension is dependent upon the rate of discharge of excess air. The total volumes of air cannot be varied, however, the ratio of air for pressure and liquid break-up can be varied by regulator 17. Predaceous mites are usually dispensed with the regulator set at from about 0.5 to about 1.0 psi (pounds per square inch). Eggs are usually dispensed with the regulator set at about 0.5 to about 10.0 psi. The volume of flow of the aqueous suspension is also regulated by adjustable screw-clamp 21 that restricts the inside orifice of aqueous suspension line 30 which leads to spray gun 23. Orifice diameter variation also alters spray pattern, with larger volume of suspension producing a coarse spray and smaller volume of suspension producing a fine spray. Thus, the rate of insects or eggs dispensed can be adjusted by the ratio of the volume of the suspension and the number of insects or eggs, the setting of back pressure regulator 17, and the setting of screw-clamp 21 on aqueous suspension line 30. For temporary interruption of aqueous suspension, TYGON™ tube 29 is crimped by the thumb of the operator at pressure point 28. A solenoid valve can also be placed between tank 10 and gun 23 to temporarily shut off the flow of the aqueous suspension. The on/off switch of the solenoid valve can be located on handle 23*c* of gun 23. When compressor 13 is turned off, pressure release valve 19 is opened to relieve tank pressure. If this is not done the tank remains under pressure. To depressurize Sprayer 40 for refilling or for emptying tank 10 through port 10*a*, pressure release valve 19 is opened. Valve 19 also allows for rapid release and automatic return of preset pressure on the aqueous suspension assembly after refilling tank 10.

The following examples illustrate the invention and are not intended to limit the scope of the invention as defined by the claims. The predaceous mites, *Phytoseiulus persimilis*, *Phytoseiulus macropilus* and *Neoseiulus californicus*, the eggs of *predator Chrysoperla rufilabris*, and the egg parasite *Trichogramma pretiosum* contained in *Ephestia kuhniella* eggs are used as test model systems.

EXAMPLE 1

Laboratory tests were performed to evaluate the survival of Phytoseiulus persimilis in water containing 40 mg surfactant (Dawn® dishwashing detergent)/liter water. 3,000 mites were added to one liter of the water solution. The mites were sprayed at 1 PSI onto 5×7 index cards and observed immediately. In 28 replications, each averaging 7.3 mites/card, 168 mites (82.4%) survived application by sprayer 40.

EXAMPLE 2

A field test was performed to evaluate the survival and increase of the mites *Neoseiulus callfornicus* and *Phytoseiulus macropilus* on roses infested with two-spotted spider mites, *Tetranychus urticae*. 1,000–4,000 mites are added to one liter of water containing 40 mg surfactant (Dawn dishwashing detergent)/liter of water. Mites are sprayed onto roses at 1 PSI and the number of mites are observed over a five week period. The results are shown below in Table 1. Data was pooled since the number of eggs/liter did not yield different results.

TABLE 1

| | Number Mites found/compound leaf | | | | |
|---|---|---|---|---|---|
| Species Tested | Date: 5/8 | 5/15 | 5/22 | 5/29 | 6/5 |
| *N. californicus* | 0.2 | 0.3 | 1.2 | 5.6 | 5.0 |
| *P. macropilus* | 0 | 0.1 | 0.9 | 1.0 | 1.6 |
| *T. urticae* | 106.6 | 293.6 | 685.1 | 832.1 | 342.4 |

EXAMPLE 3

Tests were performed to determine pressure settings for spraying beneficial insect eggs. Approximately 10 grams of randomly selected eggs of *Chrysoperla rufilabris* were added to 1 ½ liters of water containing Smucker Biocarrier (Smucker Manufacturing.Inc., 22919 No. Coburg Road, Harrisburg, Oreg. 97446) in a ratio of 8:1 (water:Smucker Biocarrier). Eggs were sprayed onto sticky tape and percent hatch at various pressure settings was evaluated. Results are shown in Table 2 below.

TABLE 2

| Pressure setting (PSI) | Number of eggs observed | Percent hatch |
|---|---|---|
| 0.5 | 50 | 48 |
| 1.0 | 50 | 50 |
| 2.0 | 50 | 52 |
| 4.0 | 50 | 46 |
| 8.0 | 50 | 52 |
| 16.0 | 50 | 38 |

EXAMPLE 4

A field test was performed to determine adult emergence of *Trichogramma pretiosum* from *Ephestia kuhniella* eggs applied to pecan foliage with sprayer 40. Approximately $1\times10_6$ eggs are added to water containing Smucker Biocarrier in a ratio of 8:1 (water:Smucker Biocarrier). Eggs were sprayed at 2 PSI onto four pecan trees. Trees received approximately 169,000 *T. pretiosum* per tree. Six days after application of the parasitized *E. kuhniella* eggs, twenty compound leaves from four trees were examined for adult *T. pretiosum*. Results are presented below in Table 3. Recovered adults averaged 2.3/compound leaf.

TABLE 3

| Replication | Number of Ephestia eggs received | Number of Trichogramma adults emerging | Percent emergence |
|---|---|---|---|
| 1 | 83 | 61 | 73.5 |
| 2 | 122 | 90 | 73.8 |
| 3 | 81 | 63 | 77.8 |
| 4 | 107 | 69 | 64.4 |
| T | | | 289.5 |
| $\bar{x}$ | | | 72.4 |

The foregoing detailed description is for the purposes of illustration. Such detail is solely for that purpose and those skilled in the art can make variations therein without departing from the spirit and scope of the invention.

Index of the Elements

1. Bottom shelf
2. 12-V deep cycle (DC) battery
3. Aluminum frame upright
4. DC-AC inverter
5. Middle shelf
6. Rheostat
7. Rheostat on/off control
8. Tank mount supports
9. Tank mount shelf
10. One gallon pressurized spray tank
10*a*. Tank fill port
10*b*. Pump housing
10*c*. Stir bar magnet
10*d*. Stir bar assembly
10*e*. Aqueous suspension pick-up tube
10*f*. Aqueous suspension pick-up tube port
10*g*. Plastic adaptor
10*h*. Pump handle
10*i*. ⅛" brass threaded rod; ¾' length
10*j*. ⅛" brass nut
10*k*. Small brass screw
10L. Spindle attachment holding stir bar magnet
10*m*. Nylon flange
10*n*. Supporting frame assembly
10*p*. Nylon receptacle for frame and spindle attachment
10*q*. Base of pump housing
11. 3/16" ID TYGON™ tubing compressed air line
12. Top shelf
13. 12-VDC diaphragm compressor
14. Controls support arm
15. 12 VDC heavy duty toggle switch
16. Back-pressure regulator control knob
17. Back-pressure regulator
18. 0–30 pound per square inch (psi) pressure gauge
19. Pressure release valve
20. ¼" quick disconnect
21. TYGON™ tube flow regulator screw clamp
22. Air bleed-off line
23. Spray gun
23*a*. ¼" OD copper tube 1" Length
23*b*. ½" copper cap 23*c*. Spray gun handle, ½" ID rigid copper tube, 4" length 23*d*. Body of spray gun, ½" ID rigid copper tube, 6" length 23*e*. ½" ID rigid copper tube, 1 ¼" length 23*f*. ½" copper T 23*g*. ⅛" OD copper tube, 10" length 23*h*. Aqueous suspension outlet port ⅛" OD copper tube 23*i*. Upper air outlet 23*j*. Lower air outlet 23*k*. ⅛" OD copper tube; 1" length 23L. Spray gun nozzle 23*m*. Aqueous suspension outlet 28. Pressure point 29. Aqueous Suspension Line 30. Aqueous Suspension Line, 3/16" ID TYGON™ tube 31. Rubber tie-down for tank 32. Aluminum frame brace 33. 115 V AC magnetic stir motor 34. Magnetic stir-bar stirring device 34*a*. Motor magnet 35. Aluminum backpack frame 36. Battery tie-down 37. 3/16" TYGON™ tubing air bleed-off line from tank to regulator 38. Quick disconnect 40. Backpack Sprayer 42. Bulkhead fitting 42*a*. Pressurization port 43. ¼" Bulkhead fitting 43*a*. Pressure bleed-off port 44. Wire 46. Wire 47. Wire 48. AC-DC Invertor bracket 49. PVC Cap 50. Wire 51. Wire 52. Wire

We claim:

1. A method for treating agricultural commodities comprising filling a spray tank with an aqueous suspension containing biocontrol agents selected from the group consisting of viable arthropods, arthropod eggs, arthropod parasitoids contained in arthropod eggs and mixtures thereof, pressurizing said tank by pumping in pressurized air into the tank in order to move said suspension from the tank to a spray gun, moving said aqueous suspension out of said spray gun, applying air from two directions on the aqueous suspension as it exits said spray gun to produce a fine spray pattern of said suspension, and covering said agricultural commodities with said fine spray.

2. A backpack spraying device comprising an air system comprising a compressor operatively connected to an aqueous solution system containing biocontrol agents selected from the group consisting of viable arthropods, arthropod eggs, arthropod parasitoids contained in arthropod eggs and mixtures thereof, a pressure regulator operatively connected to said aqueous solution system, and a spray gun operatively connected to said pressure regulator; and an aqueous system comprising a spray tank comprising a means for evenly distributing said arthropods at any life stage in said aqueous suspension, said tank in fluid communication with said spray gun;

wherein said device dispenses viable biocontrol agents.

3. The device of claim 2 wherein said pressure regulator uses excess air generated by said compressor to create a spray of an aqueous solution containing said biocontrol agents as said solution exits said spray gun.

4. A backpack spraying device comprising an air system comprising a compressor operatively connected to an aqueous solution system containing biocontrol agents selected from the group consisting of viable arthropods, arthropod eggs, arthropod parasitoids contained in arthropod eggs and mixtures thereof, a pressure regulator operatively connected to said aqueous solution system, and a spray gun operatively connected to said pressure regulator wherein said spray gun comprises a handle operatively connected to said aqueous solution system, a spray gun body operatively connected to said spray gun handle and said pressure regulator, and a nozzle comprising an upper air outlet, an aqueous suspension outlet, and a lower air outlet wherein said upper and lower air outlets are bent so that air exits the outlets at 45° angles to an aqueous suspension exiting said aqueous suspension outlet.

5. The device of claim 4 wherein said tank has an inner concave bottom.

* * * * *